US005087326A

United States Patent [19]

Jones

[11] Patent Number: 5,087,326

[45] Date of Patent: Feb. 11, 1992

[54] ROTATING PULP BLEACHING REACTOR HAVING INNER AND OUTER SHELLS AND LIFTING MEANS ON THE INTERIOR SURFACE OF THE INNER SHELL

[75] Inventor: Stuart T. Jones, Franklin, Va.

[73] Assignee: Union Camp Patent Holding, Inc., Wayne, N.J.

[21] Appl. No.: 658,284

[22] Filed: Feb. 20, 1991

[51] Int. Cl.[5] ..... D21C 7/02

[52] U.S. Cl. ..... 162/244; 162/246; 422/209

[58] Field of Search ..... 162/243, 244, 246, 57; 422/209

[56] References Cited

U.S. PATENT DOCUMENTS 1,591,070 7/1926 Wolf .

FOREIGN PATENT DOCUMENTS 308314 3/1989 European Pat. Off. .

OTHER PUBLICATIONS

Allison, R. W., "Effect of Ozone on High-Temperature Thermomechanical Pulp", *Appita,* vol. 32, No. 4 (Jan. 1979) p. 279.

Allison, "Production of Bleached Softwood Pulp by Low Pollution Processes", Wood Sci. Technol. 17, pp. 129-137 (1983).

Carlberg et al., "Bleaching of Sulphite and Sulphate Pulps Using Conventional and Unconventional Sequences", TAPPI Proceedings 1982 Annual Meeting, p. 381.

Loras et al., "Bleaching of Sulphite Pulps With Oxygen and Ozone", Report of 1982 International Pulp Bleaching Conference, p. 45.

Mbachu et al., "The Effect of Acetic and Formic Acid Pretreatment on Pulp Bleaching With Ozone", *TAPPI,* vol. 64, No. 1 (Jan. 1981) p. 67.

Liebergott et al., "The Use of Ozone in Bleaching andd Brightening Wood Pulps: Part I-Chemical Pulps" (TAPPI 1978), p. 90

Lindquist, "Ozone Bleaching of Sulfite Pulps", *Svensk Papperstidning* (Nov. 6, 1984) p. 54.

Soteland, N., "Bleaching of Chemical Pulps with Oxygen and Ozone", Pulp and Paper Magazine of Canada, vol. 75, No. 4 (Apr., 1974) p. 91.

Rothenberg et al., "Ozone Bleaching of Oxygen Pulp", Proceedings of the 1982 Pulping Conference, p. 341.

*Primary Examiner*—Steve Alvo

*Attorney, Agent, or Firm*—Pennie & Edmonds

[57] ABSTRACT

An apparatus for bleaching pulp particles comprising an inner tubular shaped shell member with lifter blades mounted on its internal wall surface. The shell member is rotatably mounted within an outer shell member with seals between the shell members providing an isolated space. This space is pressurized with a gas to prevent pulp particles and gases from escaping from the inner shell member by way of the seals.

16 Claims, 1 Drawing Sheet

ROTATING PULP BLEACHING REACTOR HAVING INNER AND OUTER SHELLS AND LIFTING MEANS ON THE INTERIOR SURFACE OF THE INNER SHELL

FIELD OF THE INVENTION

This invention relates to a novel bleaching apparatus for delignifying and bleaching lignocellulosic pulp with a gaseous bleaching agent.

BACKGROUND OF THE INVENTION

Wood is comprised of two main components—a fibrous carbohydrate, i.e., cellulosic portion, and a non-fibrous component. The non-fibrous portion of the wood is comprised primarily of phenylpropane units, known as lignin. Part of the lignin is between the cellulosic fibers, bonding them into a solid mass, although a substantial portion of the lignin is also distributed within the fibers themselves.

For use in paper-making processes, wood is first reduced to pulp. Pulping of the wood by the well known Kraft or modified Kraft pulping processes results in the formation of a dark colored slurry of cellulose fibers known as "brownstock". The dark color of the brownstock is attributable to the fact that not all of the lignin has been removed during pulping and that lignin that does remain has been chemically modified in pulping to form chromophoric groups. Thus, in order to lighten the color of the brownstock pulp, i.e., to make it suitable for use in printing and writing and for other white paper applications, it is necessary to continue the removal of the remaining lignin by the addition of delignifying materials and by chemically converting any residual lignin into colorless compounds by a process known as "bleaching" or "brightening".

Various bleaching apparatus utilizing chlorine, oxygen or ozone have been tried. In the past, rotary bleachers of various types have been utilized for bleaching low density pulp by a batch operation. U.S. Pat. No. 1,591,070 to Wolf discloses an improvement on such reactors wherein, in one embodiment, the shell includes a plurality of arm members secured to its inner surface thereof and extending radially inwardly. This shell is used in combination with a stationary central shaft which also includes radial arm members in a staggered relation to those of the shell. Thus, when the shell is rotated, the arm members agitate the pulp to break up lumps and cause the fibers to mingle thoroughly with the bleach. In another embodiment, Wolf discloses that the shell may be angled with respect to the horizontal and provided with a feeding device and an outlet so that the pulp can pass through the reactor by gravity or displacement with the continued rotation of the shell.

Later developments included apparatus which are constructed as a tubular or cylindrical reactor with a central shaft having attached arm members. The central shaft is rotated so that the arm members function to distribute the pulp particles within the internal volume of the reactor and thus expose the particles to a gaseous bleaching agent which is introduced into the reactor. With such apparatus, the construction of the shaft and arm members and their required mode of operation are generally complicated. Further, the shaft structure may itself impede proper mixing of the pulp particles with the gaseous bleaching agent as well as interfere with the feeding of the pulp particles through the apparatus.

SUMMARY OF THE INVENTION

The present invention relates to a bleaching apparatus of simplified construction. The apparatus of the present invention includes a tubular shaped reactor shell member in which the internal volume is free of any central shaft and connected arm members. A mixing or reaction zone is defined and bounded by the internal wall surface of the shell. The shell includes an input at one end for introducing pulp particles and an output at the other end for removing the pulp particles once they have been treated by the gaseous bleaching agent. The shell further includes an input for introducing a gaseous bleaching agent into the reaction zone.

In order to direct the pulp particles into the gaseous bleaching agent, the shell is mounted for rotation about its longitudinal axis and lifter blade members are mounted on its internal wall surface. The lifter members extend along the axial length of the shell and further function to advance the pulp particles through the shell simultaneously with the mixing of the pulp particles with the gaseous bleaching agent.

The pulp particles are also advanced through the reactor by tipping the inner shell relative to the horizontal. The pulp particles thus move under the influence of gravity in a direction toward the output end of the shell.

The reactor shell member described above, is contained within another outer shell member. This outer shell is also tubular or cylindrical in shape and is spaced from the inner shell to define a space between the two shell members. The inner shell is supported on the internal wall surface of the outer shell to permit the required rotation of the inner shell; and a drive is connected to the inner shell to effect rotation.

Seals are provided at the output and input ends of both shell members to isolate the space between the shells from the interior of the inner shell and from the exterior of the outer shell. This isolated space is pressurized with a gaseous medium. The pressurization acts on the seals to prevent escape of gaseous bleaching agent from the inner shell and to keep the seals clean of pulp particles being thrown around internally of the inner shell and which otherwise would tend to enter and interfere with the seals.

DETAILED DESCRIPTION OF THE INVENTION

Figures 1, 2:
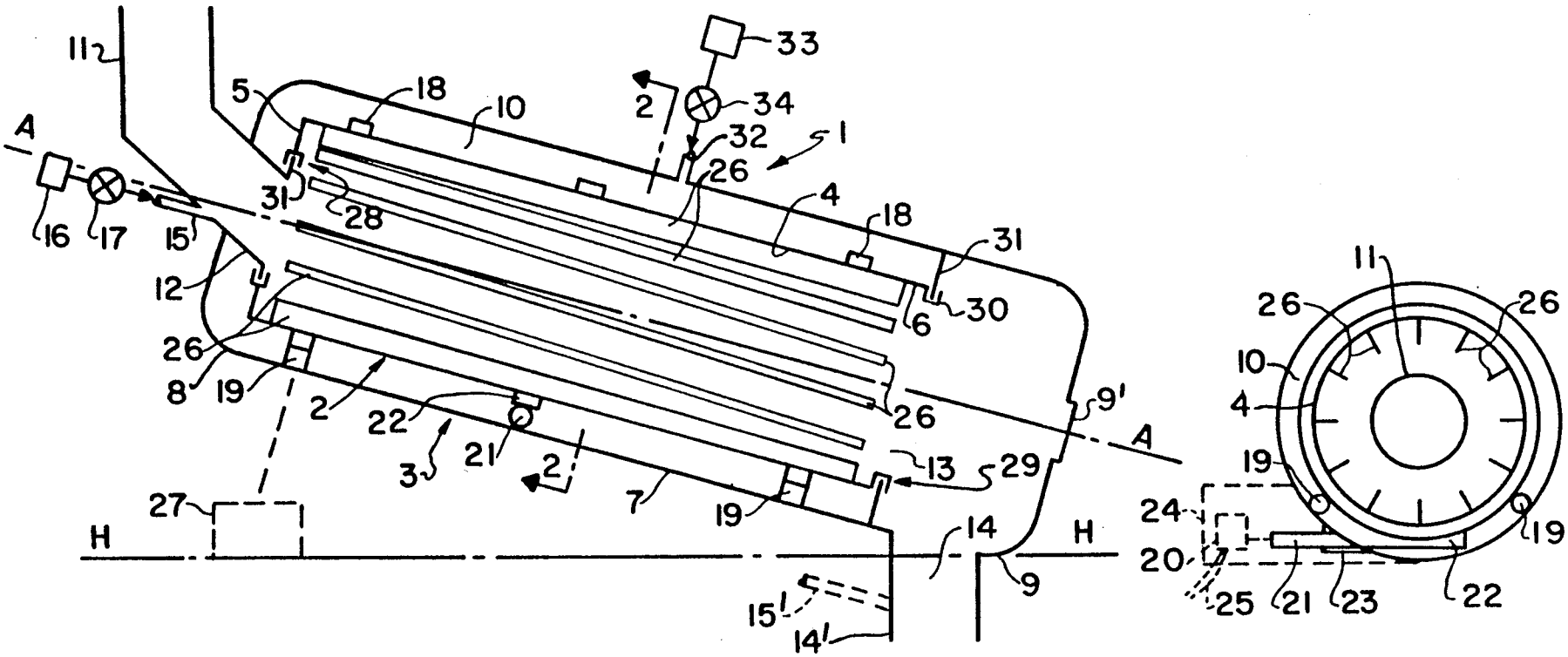
FIG. 1 is a side view, in schematic form, of the reactor constructed in accordance with the present invention.
FIG. 2 is a cross-sectional view taken along lines 2—2 of FIG. 1.

The reactor of the present invention is suitable for use in various systems for delignifying and brightening pulp. The reactor of the present invention is particularly suited for ozone bleaching of the pulp particles in a system such as disclosed in copending application Ser. No. 07/525,808, filed May 17, 1990 and assigned to the same assignee as the present application. The disclosure of this earlier application is incorporated by reference herein. The earlier application discloses the appropriate treating steps to which the pulp is subjected prior to introduction into the reactor of the present invention, during passage through the reactor and after exiting from the reactor.

With reference to FIG. 1, the bleaching apparatus of the present invention includes a reactor 1 comprised of an inner tubular shell member 2 and an outer tubular shell member 3. The inner shell member is constructed of a tubular wall 4 having an input end 5 and an output end 6 at the opposite ends of the axial length of the tubular wall and as measured along the axis A—A.

The outer tubular shell member is similar in construction to the inner shell member in that it includes a tubular wall 7 having an input end 8 and an output end 9. The outer shell member surrounds the inner shell member with the respective input and output ends adjacent each other. The two shell members are circumferentially and axially separated from each other to provide a space 10 between the shell members.

Suitably prepared pulp is fed to the bleaching apparatus by means of a pulp feed conduit 11. This conduit extends from a location exteriorly of the outer shell member for receiving the pulp particles and extends through the input end of both shell members. More particularly, the feed conduit is welded or otherwise fixed to the input end of the outer shell to provide an air-tight connection. An inner end portion 12 of the feed conduit extends inwardly of the input end 8 of the outer shell, through the space 10 and to the input end 5 of the inner shell member.

At the output ends of the two shell members, respective output openings 13, 14 are provided. In the inner shell member the output opening 13 is defined by the open ended construction of the inner shell member at its output end. As seen from FIG. 1, this output opening extends across the entire diameter of the inner shell member. The output opening 14 of the outer shell member is, in turn, located on the tubular wall 7 of the outer shell member at a location axially beyond the output end 6 of the inner shell member. It is defined by an output conduit 14' facing downwardly of the reactor.

As evident from FIG. 1, the internal volume of the inner shell member 2 is free of any central shaft and connected arm members. As such, the internal wall surface of the wall 4 defines a free, open mixing or reaction zone which is bounded by this internal wall surface. It is in this zone that the mixing and reacting of the pulp particles with the gaseous bleaching agent is effected. A view port 9' is provided in the output end of the outer shell. This view port is aligned with the axis A—A and the output opening 13 so that the operator can view the internal reaction zone of the inner shell member.

In order to bleach the pulp particles being advanced through the reactor, a gas conduit 15 is provided through which a suitable gaseous bleaching agent, such as ozone, is introduced into the interior of the inner shell member. The gas conduit 15 is connected to the pulp feed conduit 11 so that the flow of gaseous bleaching agent is cocurrent with the feeding of the pulp particles through the reactor. Alternatively, the gaseous bleaching agent may be introduced in a countercurrent manner by replacing the gas conduit 15 with a gas conduit 15' connected to the reactor at the output conduit of the outer shell member.

The gaseous bleaching agent is introduced through the conduit 15 from a source 16 by means of a suitably controlled pump 17. The amount of gaseous bleaching agent introduced is in an amount sufficient to bleach the pulp particles as they are mixed in the reaction zone.

For directing the pulp particles into the reaction zone, the inner shell member is mounted for rotation within the outer shell member. Specifically, the inner shell member is rotatably mounted on the inner wall surface of the outer shell member by means of suitable bearings. As shown in FIG. 1, a pair of trunions 18 are fixed to the opposite ends of the inner shell member in circumferential relation therewith. These trunions engage with roller support members 19 mounted on the inner wall surface of the outer shell member.

Rotating means for rotating the inner shell about its axial length includes a drive motor 20 having an output drive in the form of a worm gear drive 21. The worm gear drive is, in turn, operatively connected to the inner shell member through engagement with a toothed annular rack 22 fixed circumferentially to the inner shell member. As shown in FIG. 2, the worm gear drive extends through the outer shell member. Suitable sealing means 23 are provided to produce a gas-tight seal of the worm gear drive with the outer shell member.

Alternatively, as also shown in FIG. 2, the outer shell member can be provided with a housing extension 24 suitably welded or otherwise connected to the outer shell member in gas-tight relationship. With this alternative construction, the entire drive system for rotating the inner shell member may be disposed within the space 10 between the shell members and with only the electrical connection to the drive, as shown at 25, extending through the housing extension. For reasons which will become apparent from the description set out hereinafter, this is advantageous in that it more definitively isolates the space 10 between the shell members. This result is attained since there are no moving parts extending through the wall of the outer shell member but only the electrical wires 25. These wires are easily sealable to the outer shell member in a gas-tight fashion at the location where they pass through the wall extension 24.

The incoming pulp material entering the inner shell member 2 is initially directed toward the bottom wall surface of the inner shell member. To direct the pulp particles into the central reaction zone, lifting and displacing means in the form of blade members 26 are mounted on the interior wall surface of the tubular wall 4 of the inner shell member. These blade members are fixed and spaced from each other circumferentially about the internal wall surface of the inner shell member. As shown in FIGS. 1 and 2, the blade members 26 are straight sided in construction and extend generally axially of the inner shell member in a slightly spiral configuration. They also extend generally radially inwardly axially of the inner shell member. The extent to which these blade members extend inwardly is related to the diameter of the inner shell member. Preferably, they extend inwardly between about 1/10 and 1/5 the diameter. Thus, with an inner shell member having a diameter of 5 feet, the blade members would extend radially inwardly between about 6 and 10 inches.

The lifter blade members further function to advance the pulp particles axially through the reaction zone and to the output end of the inner shell member. The lifter blade members can be constructed with a triangular cross-sectional configuration or some other shape and contour so as to control the mixing and advancing of the pulp particles through the reactor.

The feeding of the pulp particles through the reactor is further controlled by tilting the inner shell member at an angle to the horizontal, represented by the line H—H in FIG. 1. The angle of the tilting is such that the position of the output end of the shell members is at a level sufficiently lower than the input end to cause the pulp particles to move toward the output end under the influence of gravity as the inner shell member is rotated. This tilting may be permanent, as shown in FIG. 1. Alternatively, a suitable mechanism can be provided, as shown in dotted lines at 27, for intermittently tilting the entire reactor to position the output end of the inner shell at a level lower than the input end.

In operation, as the pulp particles are directed into the inner shell of the reactor and the gaseous bleaching agent into the reaction zone, the rotation of the inner shell member causes the lifter blade members to contact the pulp particles and lift them to the top of the inner shell member. As the pulp particles approach the top of the inner shell member, they fall off of the lifter blade members which also function to push and direct the pulp particles into the central reaction zone and axially along the reactor zone and thus toward the output end of the inner shell member. The feeding rate of the pulp particles and gaseous reaction agent, the tilting angle of the reactor, and the rotational speed of the inner shell member are suitably controlled to remove a substantial portion of the lignin from the pulp particles and thus provide an acceptable bleaching of the particles by the time they exit the reactor.

In mounting the inner shell member for rotation relative to the outer shell member, dynamic seal means 28, 29 are provided between the two shell members. These seal means are located at the input and output ends of the shell members and effectively isolate the space 10 between the walls 4 and 7 of the shell members from both the interior of the inner shell member and the exterior of the outer shell member. In construction, the seal means may be of suitable labyrinth construction.

In the embodiment of the invention shown in FIG. 1, each of the seal means includes a first annular seal part 30 of U-shaped cross-section and attached to the inner shell member at both its input and output ends. The open end of the U-shaped cross-section faces radially of the inner shell member and toward a cooperating second annular seal part 31 attached to the outer shell member at the input and output ends. At the input end 8 of the outer shell member 3, the seal part 31 is indirectly attached to the outer shell through its mounting on the inner end portion 12 of the pulp feed conduit 11. The second annular seal parts 31 rotatably engages within the U-shaped open end of the first seal parts 30.

With reactors of any significant size, it is generally difficult to provide seals at the entrance and exit points of moving parts in the reactor. With the present invention, the sealing means 28, 29 can be imperfect. This is possible due to the fact that, according to the teachings of the present invention, the isolated space 10 is subjected to a slight pressurization with a suitable gas, such as oxygen. The gas is supplied through a gas conduit 32 connected in airtight fashion to the outer shell member. The pressurizing oxygen is supplied from a suitable source 33 by a regulated pump 34. The source 33 may be obtained from other parts of the processing system or may be from a separate source. Also, other gases as, for example, the spent gases from the reactor, may be used to pressurize the space 10.

The space 10 is pressurized to a level sufficient to preclude escape of the gaseous bleaching agent from the inner shell member. The pressurization of this space is also at a level which will maintain the sealing means free of pulp particles which are being thrown about in the reaction zone of the inner shell member.

In addition, the level of pressurization of the space 10 is controlled by the pump 34 whereby the flow of oxygen through any leak points in the seal means and into the inner shell member is insignificant in amount relative to the bleaching action occurring within this shell member. With ozone bleaching, there is a large quantity of oxygen used with the ozone. Thus, the addition of slightly more oxygen from the space 10 will be insignificant.

I claim:

1. A bleaching apparatus for bleaching lignin containing pulp particles comprising:

a) an inner tubular shell member having a tubular wall with an input end and an output end at opposite ends of the axial length of the tubular wall, said inner shell member having an internal wall surface defining a free, open reaction zone bounded thereby;

b) an outer tubular shell member having a tubular wall with an input end and an output end at opposite ends of the axial length of the tubular wall, said outer shell member being disposed in surrounding relation with respect to the inner shell member to provide a space therebetween and with the input ends adjacent each other and the output ends adjacent each other;

c) pulp feed conduit means extending from a location communicating with the exterior of the outer shell member and extending through the input end of both shell members for feeding pulp particles into the inner shell member;

d) an output opening at the output end of each shell member for removing pulp particles from both shell members after passing through the reaction zone of the inner shell member;

e) rotating means for rotating said inner shell member about its axial length;

f) means for introducing a gaseous bleaching agent into the reaction zone of said inner shell member in an amount sufficient to bleach the pulp particles in said reaction zone;

g) lifting means mounted on the interior wall surface of said inner shell member for contacting the pulp particles fed into the input end of the inner shell member and directing them into the reaction zone for mixing and reacting with said gaseous bleaching agent as the inner shell member is rotated;

h) seal means extending between said shell members at the input and output ends thereof to isolate a space between the walls of the shell members from communication with both the interior of the inner shell member and the exterior of the outer shell member; and i) means for pressurizing said space between the shell members with gas at a level to maintain the seal means free of said pulp particles and gaseous bleaching agent.

2. The bleaching apparatus according to claim 1 further comprising;

a) tilting means for positioning the output end of the inner shell member at a level sufficiently lower than its input end to cause the pulp particles to move toward the output end as the inner shell member is rotated.

3. A bleaching apparatus according to claim 2 wherein said seal means includes:

a) a first annular seal part, having a U-shaped cross-section, attached to the input and output ends of one of the inner and outer shell members with the open end of the U-shaped cross section facing radially of the shell member; and b) a second annular seal part attached to the input and output ends of the other shell member and rotatably engaging within the U-shaped open end of the first seal part.

4. The bleaching apparatus according to claim 3 wherein:

a) the feed conduit means is fixed to said outer shell member in gas tight relationship and includes an inner end portion extending inwardly of the input end of the outer shell member; and b) one of the annular parts of the seal means is attached to the input end of the outer shell member by means of the inner end portion of the feed conduit.

5. The bleaching apparatus according to claim 2 wherein:

a) the output end of the inner shell member is fixed at a level lower than its input end.

6. The bleaching apparatus according to claim 5 wherein:

a) the output end of the inner shell member is open across its diameter to define the output opening of the inner shell member;

b) the output end of the outer shell member extends axially beyond the output end of the inner shell member; and c) the output opening of the outer shell member is located on the tubular wall thereof at a position axially beyond the inner shell member and facing downwardly therefrom.

7. The bleaching apparatus according to claim 6 wherein:

a) the output opening of the outer shell is defined by an output conduit connected to the tubular wall thereof.

8. The bleaching apparatus according to claim 1 wherein:

a) the inner shell member is rotatably mounted on the internal wall surface of the outer shell member for rotation relative thereto.

9. The bleaching apparatus according to claim 8 wherein:

a) the wall of the outer shell member, between said seal means, has no moving parts extending through said wall and into the space between the shell members; and b) the rotating means for rotating the inner shell member includes a drive motor having an output drive operatively connected to the inner shell member and mounted within the space between said shell members.

10. A bleaching apparatus according to claim 1 wherein:

a) the gaseous bleaching agent is ozone;

b) the space between the shell members is pressurized with oxygen; and c) the means for pressurizing said space includes means to maintain a flow of oxygen through said seal means at a level insignificant relative to the bleaching of the pulp particles with said ozone.

11. A bleaching apparatus according to claim 10 wherein:

a) the means for introducing the gaseous bleaching agent includes a gas conduit connected to the pulp feed conduit means.

12. A bleaching apparatus according to claim 10 wherein:

a) the means for introducing the gaseous bleaching agent includes a gas conduit connected to the output conduit of the outer shell member.

13. The bleaching apparatus according to claim 1 wherein:

a) the lifting means includes a plurality of circumferentially spaced fixed blade members extending axially along the axial length of the inner shell member.

14. The bleaching apparatus according to claim 13 wherein:

a) the fixed blade members extend both axially and slightly spirally along the axial length of the inner shell member.

15. A bleaching apparatus according to claim 14 wherein:

a) each of the blade members extend radially inwardly of the inner shell member between about 1/10 to 1/5 the diameter of the inner shell member.

16. A bleaching apparatus for bleaching lignin containing pulp particles comprising:

a) an inner tubular shell member having a tubular wall with an input end and an output end at opposite ends of the axial length of the tubular wall, said inner shell member having an internal wall surface defining a free, open reaction zone bounded thereby;

b) an outer tubular shell member having a tubular wall with an input end and an output end at opposite ends of the axial length of the tubular wall, said outer shell member being disposed in surrounding relation with respect to the inner shell member to provide a space therebetween and with the input and output ends of the outer shell member located adjacent and spaced axially beyond the input and output ends of the inner shell member;

c) pulp feed conduit means extending from a location communicating with the exterior of the outer shell member and extending through the input end of both shell members for feeding pulp particles into the inner shell member;

d) an output opening at the output end of each shell member for removing pulp particles from both shell members after passing through the reaction zone of the inner shell member, i) the output end of the inner shell member being open across its diameter to define the output opening of the inner shell member, and ii) the output opening of the outer shell member being located on the tubular wall thereof at a position axially beyond the inner shell member and facing downwardly therefrom;

e) means for rotatably supporting the inner shell member on the inner wall surface of tubular wall of the outer shell member;

f) rotating means for rotating said inner shell member about its axial length;

g) means for introducing an ozone containing gaseous bleaching agent into the reaction zone of said inner shell member in an amount sufficient to bleach the pulp particles in said reaction zone;

h) lifting means mounted on the interior wall surface of said inner shell member for contacting the pulp particles fed into the input end of the inner shell member, and directing them into the reaction zone for mixing and reacting with said gaseous bleaching agent as the inner shell member is rotated, said lifting means including a plurality of circumferentially spaced fixed blade members extending axially and slightly spirally along the axial length of the inner shell member;

i) tilting means for positioning the output end of the inner shell member at a level sufficiently lower than its input end to cause the pulp particles to move toward the output end as the inner shell member is rotated;

j) seal means extending between said shell members at the input and output ends thereof to isolate a space between the walls of the shell members from communication with both the interior of the inner shell member and the exterior of the outer shell member; and k) means for pressurizing said space between the shell members with oxygen at a level to maintain the seal means free of said pulp particles and gaseous bleaching agent and at a level which upon entering the reaction zone by way of the seal means, to—in which the flow of oxygen through any leak points in the seal means and in the inner shell is insignificant relative to the bleaching of the pulp particles with said ozone.

* * * * *